US007064640B2

(12) United States Patent
Dahl et al.

(10) Patent No.: US 7,064,640 B2
(45) Date of Patent: Jun. 20, 2006

(54) LOW VOLTAGE CIRCUIT BREAKER

(75) Inventors: Jörg-Uwe Dahl, Werder (DE); Hans-Joachim Kuhrt, Berlin (DE); Detlev Schmidt, Berlin (DE); Günter Seidler, Berlin (DE); Ingo Thiede, Berlin (DE); Sezai Türkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/532,175

(22) PCT Filed: Aug. 28, 2003

(86) PCT No.: PCT/DE03/02883

§ 371 (c)(1),
(2), (4) Date: Apr. 21, 2005

(87) PCT Pub. No.: WO2004/040608

PCT Pub. Date: May 13, 2004

(65) Prior Publication Data

US 2006/0044091 A1 Mar. 2, 2006

(30) Foreign Application Priority Data

Oct. 25, 2002 (DE) ..... 102 50 950

(51) Int. Cl.
*H01H 9/30* (2006.01)

(52) U.S. Cl. ..... 335/201; 218/148

(58) Field of Classification Search ..... 335/201–202; 218/148

See application file for complete search history.

(56) References Cited

U.S. PATENT DOCUMENTS

| | | | | |
|---|---|---|---|---|
| 4,885,441 | A | 12/1989 | Hisatsune et al. | |
| 6,288,621 | B1 * | 9/2001 | Rival | 335/201 |
| 6,417,474 | B1 | 7/2002 | Rakus et al. | |

FOREIGN PATENT DOCUMENTS

| | | |
|---|---|---|
| DE | 92 06 136 U1 | 9/1993 |
| EP | 1 202 304 A2 | 5/2002 |

* cited by examiner

*Primary Examiner*—Ramon M. Barrera

(57) ABSTRACT

The invention relates to a low voltage circuit breaker which comprises a contact system for a principal current and an arc extinction chamber. An are transmitting element is disposed between the contact system for the principal current and the arc extinction chamber. Said are transmitting element comprises at least one are guiding element which makes it possible to direct said arc in a certain manner to the arc extinction chamber.

18 Claims, 2 Drawing Sheets

LOW VOLTAGE CIRCUIT BREAKER

CROSS REFERENCE TO RELATED APPLICATIONS

This application is the US National Stage of Interna-tional Application No. PCT/DE2003/002883, filed Aug. 28, 2003 and claims the benefit thereof. The International Ap-plication claims the benefits of German application No. 10250950.6 filed Oct. 25, 2002, both applications are in-corporated by reference herein in their entirety.

FIELD OF THE INVENTION

The invention relates to a low voltage circuit breaker which comprises a contact system for a principal current and an arc extinction chamber. An arc transmitting element is disposed between the contact sstem for the principal cur-rent and the arc extinction chamber.

BACKGROUND OF THE INVENTION

It is known that the size, particularly the width of contact systems for the principal current of low voltage circuit breakers depends on a nominal current for which the low voltage circuit breakers have been designed. The higher this nominal current, the wider is the embodiment of the corre-sponding contact systems for a principal current. A disad-vantage here is the fact that on the basis of strongly defined proximity effects for wider contact systems for a principal current, a complicated arc extinction behavior is exhibited because the arc predominantly occurs at the edge of the wide contact systems for a principal current and ac-cordingly predominantly dwells in the edge zone of the arc extinction chamber allocated to the contact systems for a principal current. As a result, the cooling effect of the arc extinction chamber is only used in a limited manner. This leads to the fact that the arc is extinguished rela-tively late and the danger arises that ionized circuits may escape from the arc extinction chamber. This burning off or down of the arcs in the edge zone occurs both during inter-ruptions in the nominal current zone and during short-circuit interruptions of this low voltage circuit breaker.

In order to make possible an explicit transmission of arcs into extinction chambers, it is known from DE 35 39 673 A1 that an arc-conductive piece of a ferromagnetic mate-rial must be allocated to a contact system for a principal current by means of which the arcs are to be explicitly transmitted to the arc extinction chamber. The disadvantage of this arrangement is the fact that additional components must be provided which are directly connected to the contact systems for a principal current. This complicates the struc-ture of the low voltage power switch and low manufacturing and/or assembly tolerances already lead to a failure when the arcs are conducted away.

In addition, it is known in the case of a low voltage circuit breaker according to said type that provision must be made for an arc guiding element on the arc transmitting element which makes it possible to direct said arc in a de-fined manner to the arc extinction chamber (US 6,417,474 B1).

Publication US 4,885,441 describes an arc transmitting element with an arc guiding element in which the arc guiding element has two running edges running at different angles to a center line of the arc transmitting element in which case the running edges extend away from an edge zone in the di-rection of a middle zone of the arc transmit-ting element.

SUMMARY OF THE INVENTION

Is the object of the invention to ensure the trans-mission of the arc to the middle zone of the arc extinction chamber.

According to the invention, this object of the inven-tion is achieved by the claims. Because said arc transmit-ting element disposed between the contact system for a prin-cipal current and the arc extinction chamber comprises at least one arc guiding element which, in particular, has sev-eral running edges running at different angles to a center line of the arc transmitting element extending in the direc-tion of a top side of the arc extinction chamber which ex-tend away from an edge zone in the direction of a middle zone of the arc the transmitting element and as a result of the fact that the arc guiding element is formed crown-shaped and has several prongs formed ray-shaped to the center line, it is advantageously achieved, independent of the point of ori-gin of the arc, that the arc is directed away from the con-tact systems for a principal current to be protected against burning down, and that a shorter arc extinction period is reached. This results in decreasing the stress on both the contact systems for a principal current, on the one hand, and the arc extinction chamber, on the other hand, because these basically can now, by means of a defined start-up by the arc, convert their arc extinction capacity with a high degree of effectiveness. It has been proven that by provid-ing simple arc guiding elements to the arc transmitting ele-ment, it is possible to direct the arcs in a defined manner. Changes to the contact system for the principal current it-self need not be made so that the modifications according to the invention are only limited to the arc transmitting ele-ment alone. As a result, the solution according to the in-vention is very simple and can therefore also be implemented cost-effectively in mass-produced low voltage circuit break-ers.

In a preferred embodiment of the invention provision is made so that at least one arc guiding element extends at an angle to an imagined vertical line of the arc transmitting element away from an edge zone in the direction of a middle zone. —This advantageously results in the fact that the arc is directed via at least one arc guiding element approxi-mately into the middle of the arc extinction chamber so that the desired arc extinction effect can be very securely achieved.

In a further preferred embodiment of the invention pro-vision is made so that the arc guiding element has at least one running edge basically running parallel to the arc transmitting element. —As a result of this an optimum arc position can be controlled within the arc extinction chamber in a defined manner. —The running edge can be formed by a sharp-edge transition of a step.

In a preferred embodiment of the invention provision is made so that the running edges basically run parallel to the arc transmitting element. —As a result of this an optimum arc position can be controlled within the arc extinction chamber in a defined manner. —The running edges can be formed by a sharp-edged transition of a step in each case.

In addition, in a preferred embodiment of the invention provision is made so that the arc guiding element particu-larly has several running edges running at different angles to the imagined vertical line. —By means of such a ray-shaped system of the running edges on the arch transmitting ele-ment, the arc is directed safely into the middle zone of the arc extinction chamber independent of the point of ori-gin of the arc.

In further preferred embodiments of the invention there is provision for the arc guiding element to be non-positively connected to the arc transmitting element. As a result the arc guiding element can be embodied in a simple fashion. This only requires the manufacturing of an arc guiding element with a simple design—for example, as a stamped part—and the fixing of this arc guiding element to the arc transmitting element—for example, by means of welding. In the case of a correspondingly selected system of ray-shaped prongs of the stamped part, the running edges can be determined for the arc in a simple way. This particularly allows the different sizes of the arc extinction chambers can be adapted easily. The ray-shaped prongs preferably have two running edges for the arcs running at right angles to one another which run from the edge zone of the arc trans-mitting element into the middle of the arc extinction cham-ber. As a result, depending on the point of origin and the intensity, it is possible to direct said adapted arc to the arc extinction chamber.

The arc guiding element connected non-positively to the arc transmitting element in addition offers the advantage that a bigger cooling body is available in the zone of the arc transmitting element which favorably influences the extinction behavior of the arc extinction chamber.

At least one section of a wire, particularly a steel wire can also serve as an arc guiding element.

According to a further preferred embodiment of the in-vention provision can be made for at least one arc guiding element being embodied as a profile part stamped from the plane of the arc transmitting element. This simplifies manufacturing of an arc transmitting element that features arc guiding elements.

At least one end plate of a stack of extinction sheets can be used advantageously as an arc transmitting element.

Further preferred embodiments of the invention can be found in the other features mentioned in the dependent claims.

BRIEF DESCRIPTION OF THE DRAWINGS

Other advantageous further developments of the invention are explained below on the basis of the accompanying drawings. They are as follows.

DETAILED DESCRIPTION OF THE INVENTION

Figure 1:
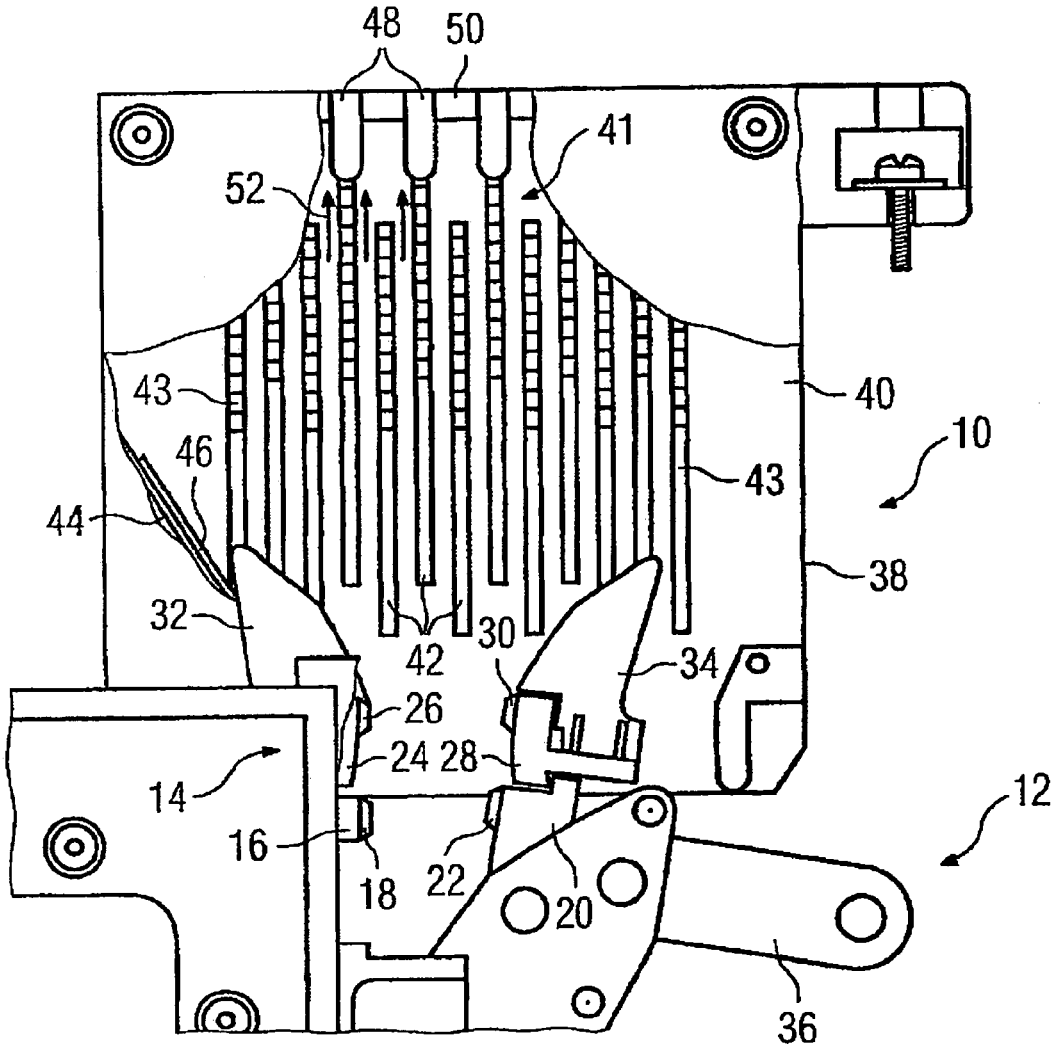
FIG. 1 partial sectional view through a low voltage circuit breaker.

FIG. 1 shows part of a sectional view of an arc ex-tinction chamber 10 of a low voltage circuit breaker 12. The low voltage circuit breaker 12 is embodied for a relatively high nominal current, for example, 1000 A.

A contact system for a principal current 14 of the low voltage circuit breaker 12 comprises a fixed principal contact 16 with a contact facing 18 as well as a movable prin-cipal contact 20 with a contact facing 22. If required, these principal contacts 16 and 20 are provided repeatedly in a parallel system. The higher the nominal current, the wider is—according to the view into the paper plane—the embodiment of the contact system for a principal current.

The principal contacts 16 and 20 are used for the arc-free transmission of the permanent current of the low volt-age circuit breaker 12 in the closed state of the principal contacts 16 and 20.

The contact system for a principal current 14 also comprises a fixed blow-out contact 24 with a contact facing 26 and a movable blow-out contact 28 with a contact facing 20. Arc horns 32 or 34 are allocated to the blow-out contacts 24 and 28.

An insulating coupling 36 serves for connection to a driving arrangement and reset device (not shown) in order to open and close the contact system for a principal current 14.

The arc extinction chamber 10 comprises a housing 38 which encloses an inner space 40 serving an arc extinction. In the inner space 40, a stack of extinction sheets 41 con-sisting of extinction sheets 42, 43 is arranged in a known way. An arc transmitting element 44 limits the inner space 40 of its fixed contact side. In principle, the arc trans-mitting element 44 is embodied plate-shaped and carries on its side facing the inner space 40, an arc guiding element 46 whose structure will be explained in greater detail below on the basis of the following drawings. The arc gases (switching gases) formed in the course of the extinction process escape from the arc extinction chamber 10 through an outlet 50, provided on the top side, subdivided into pas-sages 48; said gases escaping in the direction of the arrows 52. In addition, a further switching gas damper can be ar-ranged at the top side of the arc extinction chamber 10.

The arc guiding element 46 is arranged in the vicinity of the arc transfer points from the arc horn 32 to the arc transmitting element 44.

Figure 2:
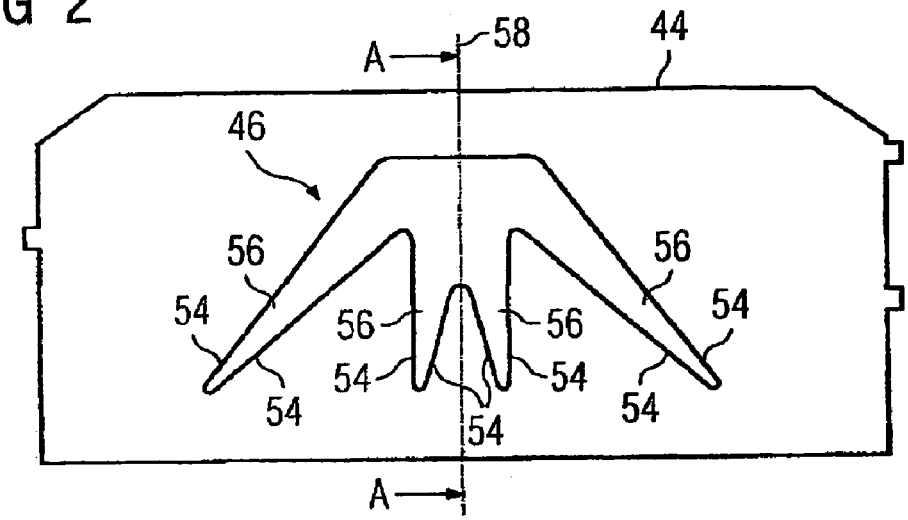
FIG. 2 view from above of an arc transmitting element.

FIG. 2 shows a view from above of an arc transmitting element 44 which clearly shows the arrangement of the arc guiding element 46 on the arc transmitting element 44. The arc guiding element 46 is arranged non-positively as an ad-ditional part on the surface of the arc transmitting element 44 and spot welded to it or joined using a similar method. According to a further embodiment, the arc guiding element 46 can be stamped from the plane of the arc transmitting element 44.

The arc guiding element 46 comprises running edges 54 which form the side limit of ray-shaped prongs 56. In this case, the running edges 54 run at different angles in each case to an imagined vertical line 58 through the arc transmitting element 44. In this case, the running edges 54 are embodied in such a way that they run from a bottom edge zone in the direction of the top middle zone of the arc transmit-ting element 44.

Figure 3:
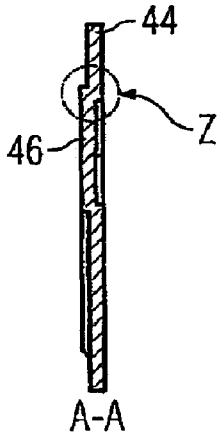
FIG. 3 sectional view through the arc transmitting element.
Figure 4:
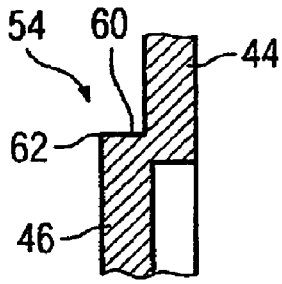
FIG. 4 enlarged detailed view of the arc transmitting element.

The sectional view in FIG. 3, as well as the enlarged detailed view in FIG. 4, show that the running edges 46 are formed by steps 60 running basically vertically to the plane of the arc transmitting element 44 so that there is a sharp-edged transition 62 on the surface of the arc guiding elements 46.

Figure 5:
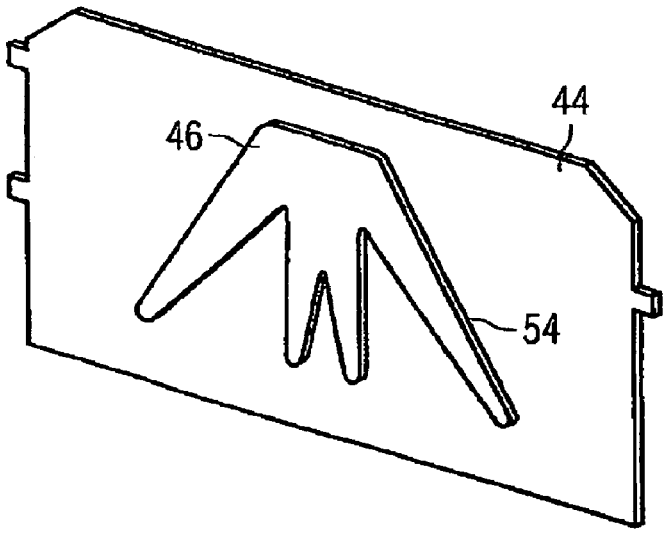
FIG. 5 schematic perspective view of an arc transmit-ting element.

FIG. 5 in a perspective view again shows the plastic protrusion of the arc guiding element 46 on the arc transmitting element 44. This results in an embodiment of the running edges 54 as sharp-edged transitions 62 of the steps 60.

The number of arc guiding elements 46 as well as the number of running edges 54 can be adapted to the design of the low voltage circuit breaker 12, particularly to the arc extinction chamber 10.

The ray-shaped running edges 54 running from the edge zones of the arc extinction chamber 10 into the middle zone of the arc extinction chamber 10 lead to the arcs originat-ing in the edge zone at the contact system for a principal current 14 being safely directed into the middle zone of the arc extinction chamber 10 where these are extinguished particularly effectively. Because of the system of an arc guiding element 46 in the transfer zone of the arc horn 32 on the arc transmitting element 44, the arcs can be directed particularly well into the middle zone of the arc extinction chamber 10.

Each one of the two end plates 43 of the stack of ex-tinction sheets 41 can be used as an arc transmitting ele-ment and as a result be provided with an arc guiding ele-ment.

According to further embodiments which are not shown, instead of the shown arc guiding element 46 which either has a crown-shaped or neck-shaped embodiment, provision can also be made for the running edges 54 being formed from welded-on individual elements, for example, steel wire or the like. However, the system of a relatively large additional part which embodies a plurality of running edges 54, at the same time, leads to an embodiment of an additional mass which has a cooling effect on the arcs at a very early point in time for the switching-off process of the low voltage circuit breaker 12 so that a further improvement of the extinction behavior is achieved.

The invention claimed is:

1. A low voltage circuit breaker, comprising:

a contact system for a principal current; and an arc extinction chamber, wherein an arc transmitting element is arranged between the contact system for the principal current and the arc extinction chamber, wherein the arc transmitting element comprises at least one arc guiding element for transmitting the arc to the arc extinction chamber in a defined manner, wherein the arc guiding element has several running edges running to a center line of the arc transmitting element extending in the direction of a top side of the arc extinction chamber, wherein the running edges extend away from an edge zone in the direction of a middle zone of the arc transmitting element, and wherein the arc guiding element is formed crown-shaped and has several prongs formed ray-shaped to the center line,

2. The low voltage circuit breaker according to claim 1 wherein the running edges basically run parallel to the arc transmitting element.

3. The low voltage circuit breaker according to claim 1 wherein the running edges are in each case formed by a sharp-edged transition of a step.

4. The low voltage circuit breaker according to claim 2 wherein the running edges are in each case formed by a sharp-edged transition of a step.

5. The low voltage circuit breaker according to claim 1 wherein the arc guiding element is frictionally connected to the arc transmitting element.

6. The low voltage circuit breaker according to claim 2 wherein the arc guiding element is frictionally connected to the arc transmitting element.

7. The low voltage circuit breaker according to claim 3 wherein the arc guiding element is frictionally connected to the arc transmitting element.

8. The voltage circuit breaker according to claim 5 wherein the arc guiding element is embodied as a stamped part.

9. The voltage circuit breaker according to claim 5 wherein the arc guiding element is formed from at least one section of a wire.

10. The voltage circuit breaker according to claim 9 wherein the wire is a steel wire.

11. The low voltage circuit breaker according to claim 1 wherein at least one arc guiding element is embodied as a profile part stamped from the plane of the arc transmitting element.

12. The low voltage circuit breaker according to claim 2 wherein at least one arc guiding element is embodied as a profile part stamped from the plane of the arc transmitting element.

13. The low voltage circuit breaker according to claim 3 wherein at least one arc guiding element is embodied as a profile part stamped from the plane of the arc transmitting element.

14. The low voltage circuit breaker according to claim 5 wherein at least one arc guiding element is embodied as a profile part stamped from the plane of the arc transmitting element.

15. The low voltage circuit breaker according to claim 1 wherein at least one extinction sheet or end plate of a stack of extinction sheets serves as the arc transmitting element.

16. The low voltage circuit breaker according to claim 2 wherein at least one extinction sheet or end plate of a stack of extinction sheets serves as the arc transmitting element.

17. The low voltage circuit breaker according to claim 3 wherein at least one extinction sheet or end plate of a stack of extinction sheets serves as the arc transmitting element.

18. The low voltage circuit breaker according to claim 1 wherein the running edges running at different angels to the center line of the arc transmitting element.

* * * * *